US005584517A

United States Patent [19]

Simnacher et al.

[11] Patent Number: 5,584,517

[45] Date of Patent: Dec. 17, 1996

[54] SECURE LATCH FOR DOUBLE-WALL STRUCTURE

[75] Inventors: Robert A. Simnacher, Vinton; Daniel J. Banyas, Cedar Rapids, both of Iowa

[73] Assignee: Lefebure Manufacturing Corporation, Cedar Rapids, Iowa

[21] Appl. No.: 491,521

[22] Filed: Jun. 16, 1995

[51] Int. Cl.[6] ..... E05B 15/02

[52] U.S. Cl. ..... 292/340; 292/346; 292/DIG. 65

[58] Field of Search ..... 292/340, 346, 292/DIG. 65

[56] References Cited

U.S. PATENT DOCUMENTS

| | | | |
|---|---|---|---|
| 1,727,323 | 9/1929 | Bartlett . | |
| 1,919,739 | 7/1933 | Minzenmayer | 292/346 |
| 2,692,158 | 10/1954 | Tirschel | 292/346 |
| 3,039,807 | 6/1962 | Agnese . | |
| 3,290,081 | 12/1966 | Sushan . | |
| 3,405,962 | 10/1968 | Sushan . | |
| 3,606,429 | 9/1971 | Palmer | 292/340 |
| 3,633,955 | 1/1972 | Read | 292/340 X |
| 3,764,173 | 10/1973 | Griffith | 292/346 |
| 3,806,176 | 4/1974 | Massie | 292/150 |
| 3,874,717 | 4/1975 | Pratt | 292/346 |
| 3,934,910 | 1/1976 | Radke | 292/346 |
| 3,967,845 | 7/1976 | Governale | 292/346 |
| 4,005,890 | 2/1977 | Murch | 292/346 |
| 4,073,525 | 2/1978 | Gurule | 292/346 |
| 4,183,568 | 1/1980 | Ferracane | 292/346 X |
| 4,189,175 | 2/1980 | Paxton | 292/346 X |
| 4,279,436 | 7/1981 | Heffel | 292/346 |
| 4,345,787 | 8/1982 | Dabrowski | 292/346 |
| 4,383,709 | 5/1983 | Ronan | 292/346 |

*Primary Examiner*—Rodney M. Lindsey
*Assistant Examiner*—Monica E. Millner
*Attorney, Agent, or Firm*—Simmons, Perrine, Albright & Ellwood PLC

[57] ABSTRACT

An improved secure latch for a fixture having a door with a double-wall structure, including an endwall with an exit port and an inner sidewall with a slot near the endwall and parallel thereto. An entry port of a facing member and an orifice of a tongue, slidably receivable through the slot, of a latch attached to the facing member are aligned with the exit port as the door is in a closed configuration such that a bolt of a lock installed in the door is slidable therethrough as the bolt is displaced between a locked configuration and an unlocked configuration. The secure latch is adapted to retain the door in a closed configuration as the bolt is in a locked configuration even though the facing member may be forced clear of the bolt. Further, the secure latch prevents the lock from being sprung open without inflicting severe and visible damage to the door and/or the facing member. A modified embodiment provides the endwall without the exit port and the facing member without the entry port. The locked configuration includes extending the bolt through the orifice of the latch.

7 Claims, 2 Drawing Sheets

Fig. 1.
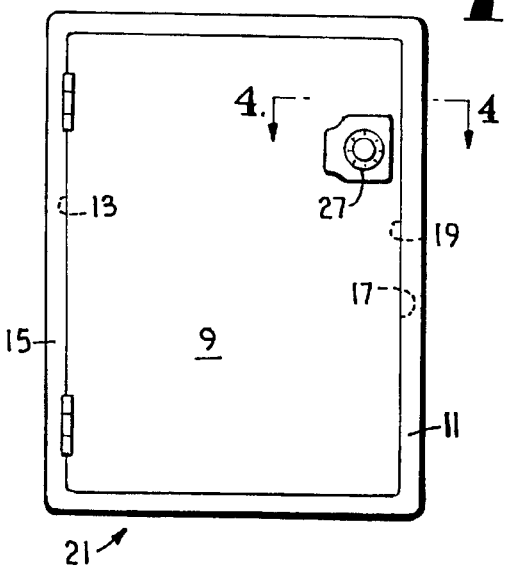
Fig. 3.
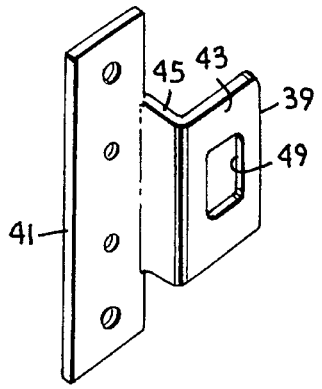
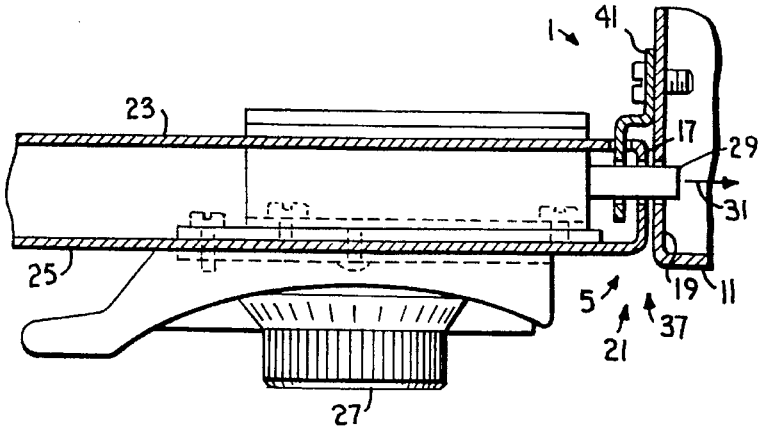
Fig. 4.
Fig. 2.
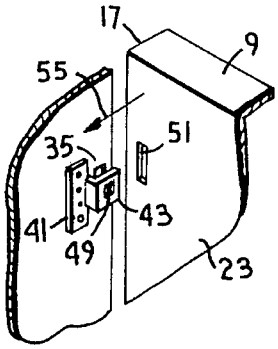
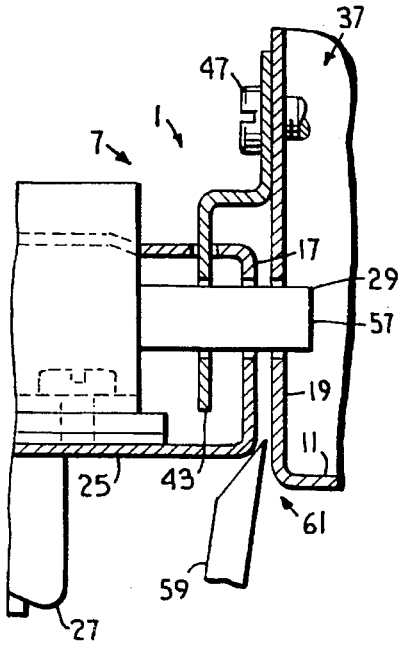
Fig. 5.

SECURE LATCH FOR DOUBLE-WALL STRUCTURE

BACKGROUND OF THE INVENTION

1. Field of the Invention

The present invention relates generally to latches for closures and, in particular, secure latches for doors having a double-wall structure.

2. Description of the Related Art

Businesses, organizations, institutions and most other types of operating entities generally have valuable documents and things which must be maintained in a secure location with limited access, such as a file cabinet, desk, closet, etc. Various devices have been utilized in an attempt to control access to such secure locations.

Unfortunately, as the devices used to control access to such secure locations have become more innovative, individuals who insist on obtaining unauthorized access thereto have become equally creative in order to swiftly, and sometimes almost effortlessly, gain clandestine access with negligible or minimal physical and/or visual damage. Simple tools, such as screwdrivers, small wrecking bars, and the like, have sometimes been used to spring a surrounding door frame whereby a secure metal cabinet may be opened, even though it may have a deadbolt-type lock. With wedging action, the frame near the door latch may be forced to yield sufficiently in order for the door to be opened without causing visible damage to the cabinet. As a result, the intrusion may go undetected for a substantial period of time before stolen articles, etc., are missed or discovered. Worse yet, if the secure area is used to protect trade secrets and other confidential and proprietary information, an interloper may undetectably steal valuable intellectual property.

What is needed is a mechanism which prevents unauthorized and/or largely undetectable access to secure locations which might otherwise be accomplished swiftly and without noticeable evidence of the intrusion.

SUMMARY OF THE INVENTION

An improved secure latch is provided for a closure having a double-wall structure. The secure latch includes a door having a dual wall structure with outer and inner sidewalls, a hinged endwall, and a distal endwall with an exit port. The inner sidewall has an appropriately dimensioned and spaced slot oriented generally parallel to, and spaced near, the distal endwall.

The door is hingedly mounted in a frame having a facing member with an entry port that is spaced in close proximity to, and aligned with, the exit port as the door assumes a closed configuration.

The secure latch also includes a latch having a tongue with an orifice, an offset portion, and a foot that is mounted on the facing member such that the tongue is slidably insertable through the slot and the orifice thereof is aligned with the exit port and the entry port as the door assumes a closed configuration.

A lock having an extendable bolt is mounted on the door such that the bolt is slidably insertable through the aligned orifice, exit port and entry port as the bolt assumes a locked configuration, and is slidably withdrawable from the orifice, exit port and entry port as the bolt assumes an unlocked configuration.

The secure latch is adapted to retain the door in a closed configuration as the bolt is in a locked configuration even though the facing member may be forced clear of the bolt. Further, the secure latch prevents a serious attempt to force entry from going unnoticed as such an attempt will generally inflict severe and visible damage to the door and/or facing member.

A modified embodiment provides the endwall without the exit port and the facing member without the entry port. The locked configuration includes extending the bolt through the orifice of the latch.

OBJECTS AND ADVANTAGES OF THE INVENTION

Therefore, the principal objects and advantages of the invention are to provide a secure latch for a door with double wall structure; to provide such a secure latch that prevents a serious attempt to force entry from going unnoticed due to evidence of significant physical and noticeable visible damage; and to provide such a secure latch that is economical to manufacture, efficient in operation, capable of long operating life and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a front elevation view of a frame, a door having a double-wall structure, and a secure latch, according to the present invention.

FIG. 2 is a perspective and fragmentary rear view of the door, showing a slot for receiving a tongue of the latch.

FIG. 3 is an enlarged and perspective view of the latch.

FIG. 4 is an enlarged and fragmentary, partially cross-sectional view of the door and the latch, taken generally along the line 4—4 of FIG. 1.

FIG. 5 is a further enlarged and fragmentary, partially cross-sectional view of the door and the latch, showing the door in a closed configuration and a bolt of a lock in a locked configuration.

DETAILED DESCRIPTION OF THE INVENTION

Figure 6:
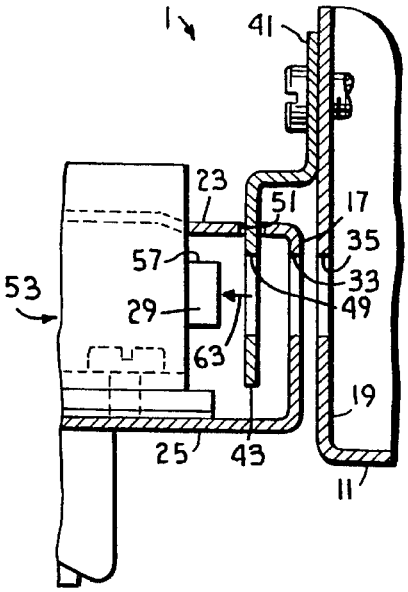
FIG. 6 is a further enlarged and fragmentary, partially cross-sectional view of the door and the latch, similar to that shown in FIG. 5, showing the door in the closed configuration but showing the bolt in an unlocked configuration, according to the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally refers to a secure latch system in accordance with the present invention, as shown in FIGS. 1 through 6. The system 1 includes closure means 3, locking means 5 and secure latching means 7.

The closure means 3 generally includes a door 9 and a frame 11. The door 9 has a first endwall 13 hinged to a hinge portion 15 of the frame 11 and a distal endwall 17, that is spaced in close proximity to a facing member 19 of the frame 11 as the door 9 assumes a closed configuration, as indicated by the numeral 21 in FIGS. 1 and 4.

The door 9 is constructed of steel, or other suitable high-strength material, and has an inner sidewall 23 and an outer sidewall 25, as shown in FIG. 4. The door 9 is configured such that the locking means 5, such as a lock 27 with a bolt 29, similar to that shown in FIG. 4, can be installed therein. The lock 27 is spaced relative to the distal endwall 17 and the facing member 19 such that, as the door 9 is in the closed configuration 21, the bolt 29 can be extended, as indicated by the arrow designated by the numeral 31 in FIG. 4, through an exit port 33 in the distal endwall 17 and an entry port 35 in the facing member 19 as the locking means 5 assumes a locked configuration, as indicated by the number 37.

The secure latching means 7 includes a latch 39 having a foot 41 and a tongue 43. The foot 41 and the tongue 43 are generally parallel to, and are offset by an offset member 45 from, each other as shown in FIG. 3, such that the tongue 43 is spaced parallel to, and outwardly from, the facing member 19 as the foot 41 is secured to the facing member 19, such as by screws 47, as shown in FIG. 5. The screws 47 are contained within the secure space behind the door 9 whereby an intruder cannot gain access thereto. The tongue 43 has an orifice 49 as hereinafter described.

The secure latching means 7 also includes the inner sidewall 23 of the door 9 having a slot 51, as shown in FIG. 2. The slot 51 is dimensioned and spaced such that, as the lock 27 is in an unlocked configuration as indicated by the numeral 53 in FIG. 6 and the door 9 is displaced, as indicated by the arrow designated by the numeral 55 in FIG. 2, to the closed configuration 21, the orifice 49 is spaced between a distal end 57 of the bolt 29 and the distal endwall 17 such that the orifice 49 is aligned with the exit port 33 and the entry port 35. The orifice 49 is dimensioned to slidably receive the bolt 29 therethrough as the bolt 29 is displaced between the locked configuration 37 and the unlocked configuration 53. If desired, the latch 39 may serve as a stop by dimensioning the spacing between the orifice 49 and the offset member 45 such that the inner sidewall 23 abuts against the offset member 45 as the door 9 assumes the closed configuration 21.

In an application of the invention, the door 9 is displaced to the closed configuration 21 as the lock 27 is in the unlocked configuration 53, as indicated by the arrow 55, such that the tongue 43 is inserted through the slot 51. Then, the lock 27 is manipulated such that the bolt 29 is extended through the orifice 49, the exit port 33, and the entry port 35, as indicated by the arrow 31.

Even though an intruder may force an instrument 59 into a juncture 61 between the distal endwall 17 and the facing member 19 such that the facing member 19 is pried clear of the bolt distal end 57, the door 9 cannot be opened by the intruder because the orifice 49 would still encircle the bolt 29, thereby retaining the door 9 in fixed relation to the facing member 19 due to the attachment of the foot 41 to the facing member 19 by the screws 47.

Further, the use of high strength material for construction of the door 9 and the facing member 19 would cause such prying by the instrument 59 to generally obviously and visibly damage the door 9 and/or the facing member 19, even though access was not obtained by the intruder. As a result, evidence of the attempted entry would be provided, thereby placing an owner on alert as to the possibility of further, subsequent attempts to attain unauthorized entry.

Obviously, authorized entry may be attained by manipulating the lock 27 such that the bolt 29 is withdrawn from the entry port 35, the exit port 33, and the orifice 49, as indicated by the arrow 63 in FIG. 6, allowing the door 9 to be opened.

Figure 7:
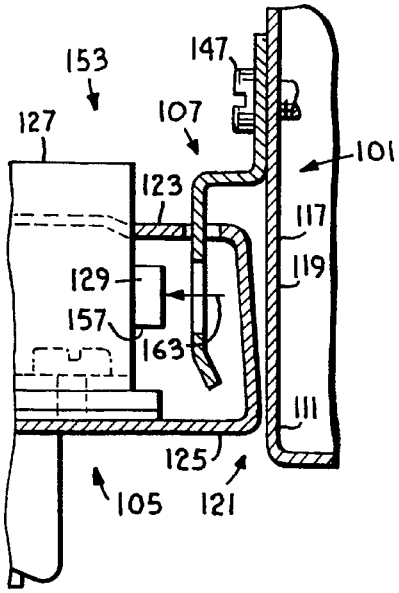
FIG. 7 is a fragmentary, partially cross-sectional view of a door, a lock with a bolt, and a latch, showing the door in a closed configuration and the bolt in an unlocked configuration, according to a modified embodiment of the present invention.
Figure 8:
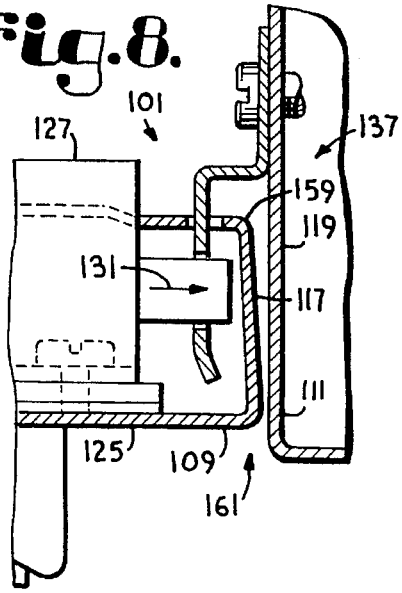
FIG. 8 is a fragmentary, partially cross-sectional view of the modified embodiment, showing the door in a closed configuration and the bolt in a locked configuration.
Figure 9:
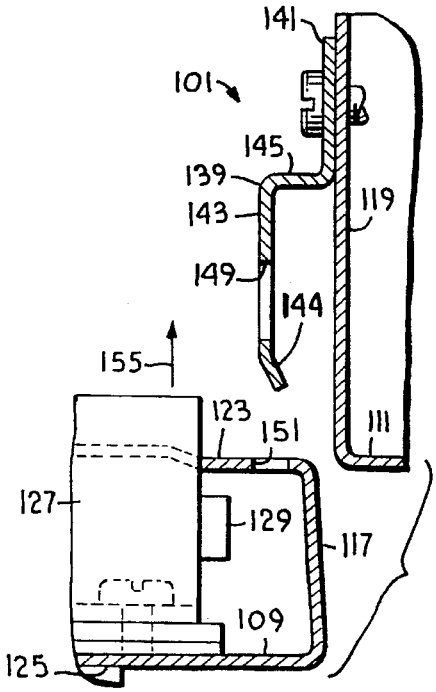
FIG. 9 is a fragmentary, partially cross-sectional view of the modified embodiment, showing the door being displaced to the closed configuration, according to the present invention.

A modified secure latch system for a double wall structure in accordance with the present invention is shown in FIGS. 7 through 9 and is generally designated by the reference numeral 101. Many of the characteristics and features of the modified secure latch system 101 are substantially similar to those previously described for the secure latch 1 and will not be reiterated here in detail.

The modified secure latch system 101 includes locking means 105, secure latching means 107, a door 109 and a frame 111. The door 109 has a distal endwall 117, that is spaced in close proximity to a facing member 119 of the frame 111 as the door 109 assumes a closed configuration, as indicated by the numeral 121 in FIG. 7.

The door 109 has an inner sidewall 123 and an outer sidewall 125, and is configured such that the locking means 105, such as a lock 127 with a bolt 129, can be installed therein. The lock 127 is spaced relative to the distal endwall 117 such that, as the door 109 is in the closed configuration 121, the bolt 129 can be extended, as indicated by the arrow designated by the numeral 131 in FIG. 8, as the locking means 105 assumes a locked configuration, as indicated by the number 137.

The secure latching means 107 includes a latch 139 having a foot 141 and a tongue 143. If desired, the tongue 143 may have a flared distal end as indicated by the numeral 144 in FIG. 9. For example, the angular orientation of the flare 144 may deviate from the orientation of the remainder of the tongue 143 by approximately two degrees. The foot 141 and the tongue 143 are generally parallel to, and are offset by an offset member 145 from, each other as shown in FIG. 9, such that the tongue 143 is spaced generally parallel to, and outwardly from, the facing member 119 as the foot 141 is secured to the facing member 119, such as by screws 147, as shown in FIG. 7. The tongue 143 has an orifice 149 as hereinafter described.

The secure latching means 107 also includes the inner sidewall 123 of the door 109 having a slot 151. The slot 151 is dimensioned and spaced such that, as the lock 127 is in an unlocked configuration as indicated by the numeral 153 in FIG. 7 and the door 109 is displaced, as indicated by the arrow designated by the numeral 155 in FIG. 9, to the closed configuration 121, the orifice 149 is spaced between a distal end 157 of the bolt 129 and the distal endwall 117 such that the orifice 149 is aligned with the bolt 129. If desired, the distal endwall 117 may be sloped inwardly away from the facing member 119, as designated by the numeral 159 in FIG. 8, to allow for the arcuate path of the distal endwall 117 as the door 109 is displaced to the closed configuration 121. For example, the included angle between the distal endwall 117 and the facing member 119 may be approximately two degrees. The orifice 149 is dimensioned to slidably receive the bolt 129 therethrough as the bolt 129 is displaced between the locked configuration 137 and the unlocked configuration 153.

In an application of the invention, the door 109 is displaced to the closed configuration 121 as the lock 127 is in the unlocked configuration 153, as indicated by the arrow 155, such that the tongue 143 is inserted through the slot 151. Then, the lock 127 is manipulated such that the bolt 129 is extended through the orifice 149, as indicated by the arrow 131.

Even though an intruder may force an instrument into a juncture 161 between the distal endwall 117 and the facing member 119, the door 109 cannot be opened by the intruder because the orifice 149 would still encircle the bolt 129, thereby retaining the door 109 in fixed relation to the facing member 119 due to the attachment of the foot 141 to the facing member 119 by the screws 147.

Authorized entry may be attained by manipulating the lock 127 such that the bolt 129 is withdrawn from the orifice 149, as indicated by the arrow 163 in FIG. 7, allowing the door 109 to be opened.

It is to be understood that while certain forms of the present invention have been illustrated and described herein, it is not to be limited to the specific forms or arrangement of parts described and shown.

What is claimed and desired to be secured by Letters Patent is as follows:

1. A secure closure, comprising:

a) a door having opposing side walls and an end wall with an exit port;

b) a facing member spaced in close proximity to said end wall as said door is in a closed configuration; said facing member having an entry port;

c) locking means for locking said door, said locking means having a bolt with a distal end adapted to be extendable through said exit port and said entry port as said door is in said closed configuration and as said locking means assumes a locked configuration, and to be retractable from said entry port and said exit port as said locking means assumes an unlocked configuration; and d) a latch having a tongue with an orifice adapted to receive said distal end of said bolt therethrough as said door is in said closed configuration; said latch mounted on said facing member such that said exit port is interposed between, and aligned with, said orifice and said entry port as said door is in said closed configuration.

2. The secure closure according to claim 1, wherein said receiving means includes a slot spaced near said endwall in one of said opposing sidewalls.

3. A secure closure, comprising:

a) a door having a dual wall structure constructed of metal; said door having an outer sidewall, an inner sidewall, a hinged endwall and a distal endwall with an exit port; said inner sidewall having a slot therethrough, said slot oriented generally parallel to and spaced near said distal endwall; said door having an open configuration and a closed configuration;

b) a facing member having an entry port spaced in close proximity to and aligned with said exit port as said door assumes said closed configuration;

c) a lock mounted on said door; said lock having an extendable bolt with a bolt distal end dimensioned to be slidably insertable through said exit port and receivable by said entry port; said bolt distal end spaced within said door and apart from said distal endwall as said bolt assumes an unlocked configuration and spaced through said exit port and received by said entry port as said bolt assumes a locked configuration;

d) a latch having a tongue with an orifice dimensioned to slidably receive said bolt therethrough as said bolt assumes said locked configuration, an offset member, and a foot, said foot mounted on said facing member; said latch adapted to be received through said slot and spaced between said bolt distal end and said distal endwall such that said orifice is aligned with said exit port and said entry port as said bolt assumes said unlocked configuration and said door assumes said closed configuration.

4. The secure closure according to claim 3, wherein said latch is adapted to retain said door in a closed configuration as said bolt is in a locked configuration even though said facing member may be forced clear of said bolt distal end.

5. A secure closure, comprising:

a) a door having an outer sidewall, an inner sidewall, and an endwall; said inner sidewall having receiving means spaced in close proximity to said endwall;

b) a facing member spaced in close proximity to said endwall as said door is in a closed configuration;

c) a latch having a tongue with an orifice; said latch dimensioned and mounted on said facing member such that said orifice is received within said door by said receiving means as said door is in said closed configuration; and d) locking means for locking said door, said locking means having a bolt with a distal end adapted to be extendable through said orifice as said door is in said closed configuration and as said locking means assumes a locked configuration, and to be retractable from said orifice as said locking means assumes an unlocked configuration.

6. A secure closure, comprising:

a) a door having opposing side walls and an end wall with an exit port;

b) a facing member spaced in close proximity to said end wall as said door is in a closed configuration; said facing member having an entry port;

c) locking means for locking said door, said locking means having a bolt with a distal end adapted to be extendable through said exit port and said entry port as said door is in said closed configuration and as said locking means assumes a locked configuration, and to be retractable from said entry port and said exit port as said locking means assumes an unlocked configuration;

d) a latch having a tongue with an orifice adapted to receive said distal end of said bolt therethrough as said door is in said closed configuration; said latch mounted on said facing member such that said exit port is interposed between, and aligned with, said orifice and said entry port as said door is in said closed configuration; and e) receiving means such that said tongue is received within said door.

7. A secure closure, comprising:

a) a door having an endwall, an exit port, a slidable bolt, and a slot spaced in close proximity to said endwall;

b) a facing member having an entry port spaced in close proximity to said exit port as said door assumes a closed position relative thereto; and c) an offset latch having a tongue with an orifice and a foot attached to said facing member; and d) wherein said latch is received through said slot and said bolt is extendable through said orifice, said exit port, and said entry port as said door assumes said closed position.

* * * * *